US009000942B2

(12) United States Patent
Atkinson et al.

(10) Patent No.: US 9,000,942 B2
(45) Date of Patent: Apr. 7, 2015

(54) BOREHOLE TELEMETRY SYSTEM

(75) Inventors: Ian Atkinson, Ely (GB); Yuehua Chen, Southampton (GB); Arthur Hartog, Southampton (GB); Franck Monmont, Caldecote (GB); Rogerio Ramos, Chandlers Ford (GB); Robert Schroeder, Newtown, CT (US); Jeffrey Tarvin, Boston, MA (US)

(73) Assignee: Schlumberger Technology Corporation, Ridgefield, CT (US)

( * ) Notice: Subject to any disclaimer, the term of this patent is extended or adjusted under 35 U.S.C. 154(b) by 1659 days.

(21) Appl. No.: 11/598,459

(22) Filed: Nov. 13, 2006

(65) Prior Publication Data

US 2007/0126594 A1 Jun. 7, 2007

(30) Foreign Application Priority Data

Dec. 6, 2005 (GB) ..... 0524827.3

(51) Int. Cl.
*H04B 13/02* (2006.01)
*E21B 47/12* (2012.01)

(52) U.S. Cl.
CPC ..... *E21B 47/123* (2013.01)

(58) Field of Classification Search
CPC ..... G01V 3/00
USPC ..... 340/854.7; 358/124, 128; 166/336, 166/254.2; 367/83
See application file for complete search history.

(56) References Cited

U.S. PATENT DOCUMENTS 4,068,191 A 1/1978 Zemon et al.
4,584,470 A 4/1986 Iizuka et al.
4,849,753 A * 7/1989 Merry ..... 340/854.7
4,859,059 A 8/1989 Bobb et al.
4,918,303 A * 4/1990 Gergely ..... 250/227.17
4,991,923 A 2/1991 Kino et al.
4,996,692 A * 2/1991 Kabacoff ..... 372/26
5,111,331 A * 5/1992 Rosenberg ..... 359/296

(Continued)

FOREIGN PATENT DOCUMENTS

GB 2 019 561 10/1979
GB 2 126 820 3/1984

(Continued)

OTHER PUBLICATIONS

Berwick et al. 'Alternating-current measurement and non-invasive data ring utilizing the Faraday effect in a closed-loop fiber magnetometer' Optics Letters, vol. 12 (4), 1987,p. 293-295.

(Continued)

*Primary Examiner* — Hai Phan
*Assistant Examiner* — Amine Benlagsir

(57) ABSTRACT

A telemetry apparatus and method for communicating data from a down-hole location through a borehole to the surface is described including a light source, an optical fiber being placed along the length of the wellbore and receiving light from the light source, a transducer located such as to produce a force field (e.g. a magnetic field) across the optical fiber and its protective hull without mechanical penetration of the hull at the down-hole location, one or more sensors for measuring down-hole conditions and/or parameters, a controller to provide a modulated signal to the magnetic field generator, said modulated signal being under operating conditions representative of measurements by the one or more sensors, and an optical detector adapted to detect changes in the light intensity or polarization of light passing through the fiber.

43 Claims, 6 Drawing Sheets

(56) References Cited

U.S. PATENT DOCUMENTS

| | | | | |
|---|---|---|---|---|
| 5,675,674 | A | 10/1997 | Weis | |
| 5,745,047 | A * | 4/1998 | Van Gisbergen et al. | 340/853.1 |
| 5,808,779 | A | 9/1998 | Weis | |
| 5,872,876 | A * | 2/1999 | Kluth et al. | 385/12 |
| 5,898,517 | A | 4/1999 | Weis | |
| 6,072,567 | A * | 6/2000 | Sapack | 356/32 |
| 6,233,746 | B1 * | 5/2001 | Skinner | 250/227.18 |
| RE37,283 | E | 7/2001 | Kluth et al. | |
| 6,271,766 | B1 * | 8/2001 | Didden et al. | 340/853.1 |
| 6,281,489 | B1 * | 8/2001 | Tubel et al. | 250/227.14 |
| 6,374,913 | B1 * | 4/2002 | Robbins et al. | 166/66 |
| 6,462,856 | B1 | 10/2002 | Marcuse et al. | |
| 6,640,900 | B2 * | 11/2003 | Smith | 166/336 |
| 6,913,079 | B2 * | 7/2005 | Tubel | 166/250.01 |
| 2002/0007945 | A1 * | 1/2002 | Neuroth et al. | 166/66 |
| 2002/0039465 | A1 * | 4/2002 | Skinner | 385/15 |
| 2002/0131114 | A1 * | 9/2002 | Yoo | 359/124 |
| 2002/0182589 | A1 * | 12/2002 | Knudsen et al. | 435/4 |
| 2002/0196993 | A1 * | 12/2002 | Schroeder | 385/12 |
| 2003/0010500 | A1 * | 1/2003 | Smith | 166/336 |
| 2003/0020631 | A1 * | 1/2003 | Haase et al. | 340/853.1 |
| 2004/0033017 | A1 * | 2/2004 | Kringlebotn et al. | 385/31 |
| 2005/0012036 | A1 * | 1/2005 | Tubel et al. | 250/227.14 |
| 2005/0207279 | A1 * | 9/2005 | Chemali et al. | 367/83 |
| 2005/0263281 | A1 * | 12/2005 | Lovell et al. | 166/255.1 |
| 2006/0038115 | A1 * | 2/2006 | Maas | 250/227.18 |
| 2006/0115335 | A1 * | 6/2006 | Allen et al. | 405/274 |
| 2006/0157239 | A1 * | 7/2006 | Ramos et al. | 166/254.2 |
| 2007/0068242 | A1 * | 3/2007 | DiFoggio | 73/152.55 |
| 2007/0237739 | A1 * | 10/2007 | Doty | 424/78.08 |
| 2010/0018703 | A1 * | 1/2010 | Lovell et al. | 166/255.2 |

FOREIGN PATENT DOCUMENTS

| | | |
|---|---|---|
| GB | 2 205 174 | 11/1988 |
| GB | 2 409 871 | 7/2005 |
| WO | 2004/085796 | 10/2004 |
| WO | 2005/024177 | 3/2005 |

OTHER PUBLICATIONS

Jackson et al 'Interferometers—Magnetometry based on Faraday rotation' in Optical Fibers Sensors: Systems and Applications ed. Culshaw & Dakin, vol. 2, 1989, pp. 365-366.

Kist 'Point Sensor Multiplexing Principles' in Optical Fibers Sensors: Systems and Applications ed. Culshaw & Dakin, vol. 2, 1989, pp. 514-521.

Lefèvre 'Fiber-Optic Gyroscope' in Optical Fibers Sensors: Systems and Applications ed. Culshaw & Dakin, vol. 2, 1989, pp. 405-408.

Rashleigh et al 'Magneto-optic current sensing with birefringent fibers' Applied Physics Letters, 34, pp. 768-770, 1979.

Examination Report of Canadian Application No. 2,568,481 dated Jan. 17, 2013: pp. 1-3.

* cited by examiner

BOREHOLE TELEMETRY SYSTEM

The present invention generally relates to an apparatus and a method for communicating parameters relating to down-hole conditions to the surface. More specifically, it pertains to such an apparatus and method for communication using an optical fiber.

CROSS-REFERENCE TO RELATED APPLICATIONS

This application claims the benefits of priority from Application Number 0524827.3, entitled "BOREHOLE TELEMETRY SYSTEM," filed in the United Kingdom on Dec. 6, 2005, and which is commonly assigned to assignee of the present invention and hereby incorporated by reference in its entirety.

BACKGROUND OF THE INVENTION

One of the more difficult problems associated with any borehole is to communicate measured data between one or more locations down a borehole and the surface, or between down-hole locations themselves. For example, communication is desired by the oil industry to retrieve, at the surface, data generated down-hole during operations such as perforating, fracturing, and drill stem or well testing; and during production operations such as reservoir evaluation testing, pressure and temperature monitoring. Communication is also desired to transmit intelligence from the surface to down-hole tools or instruments to effect, control or modify operations or parameters.

Accurate and reliable down-hole communication is particularly important when complex data comprising a set of measurements or instructions is to be communicated, i.e., when more than a single measurement or a simple trigger signal has to be communicated. For the transmission of complex data it is often desirable to communicate encoded digital signals.

Widely considered for borehole communication is to use a direct wire connection between the surface and the down-hole location(s). Communication then can be made via electrical signal through the wire. While much effort has been spent on "wireline" communication, its inherent high telemetry rate is not always needed and very often does not justify its high cost.

Another borehole communication technique that has been explored is the transmission of acoustic waves. Whereas in some cases the pipes and tubing within the well can be used to transmit acoustic waves, commercially available systems utilize the various liquids within a borehole as the transmission medium. Examples of the use of hydraulic lines for downhole power generation and telemetry are described in WO 2004/085796 A1 and WO 2005/024177 A1.

Yet another borehole communication system is based on optical signals. Communication over an optical fiber is accomplished by using an optical transmitter to generate and transmit laser light pulses that are communicated through the optical fiber. Downhole components can be coupled to the optical fiber to enable communication between the downhole components and surface equipment. Examples of such down-hole components include sensors, gauges, or other measurement devices.

Typically, an optical fiber is deployed by inserting the optical fiber into a control line, such as a steel control line, that is run along the length of other tubing (e.g., production tubing). The control line is provided as part of a production string that is extended into the wellbore.

As described for example in the published United Kingdom patent application GB 2409871 A, optical fibers can also be applied to intervention, remedial, or investigative tools as being deployed by a wireline, slickline, coiled tubing, or some other type of conveyance structure.

Further uses of optical fibers for communication inside a wellbore are described in the related U.S. Pat. Nos. 5,898,517, 5,808,779 and 5,675,674, which describe an optical fiber modulation and demodulation system using Bragg gratings and piezoelectric crystal combination.

However, a major limitation of conventional optical communications systems applied to hostile environments such as hydrocarbon production wells is the need to terminate the fiber at each node of the communication system. The termination might be accomplished by connecting the optical cable to the communication node, which involves expensive parts and lengthy procedures to ensure that the connection is hermetically sealed against the ingress of the downhole fluids. Alternatively, special optical connectors might be used that are suitable for the hostile environment; however these are expensive. In both cases these connections, whether spliced or connectorised are expensive and create a weak point that could degrade the overall reliability of the communications system.

Outside the technical field of borehole telemetry, Berwick M. and al. describe a magnetometer in their paper: "Alternating-current measurement and non-invasive data ring utilizing the Faraday effect in a closed-loop fiber magnetometer" Optics Letters Vol. 12. No. 4, 1987. Berwick M. and al. also propose to use the system as data ring. Similar methods and apparatus can be found in the U.S. Pat. Nos. 6,462,856 B1 and 4,996,692.

It is therefore an object of the present invention to provide optical fiber based communication system that overcomes the limitations of existing devices to allow the communication of data into one or more nodes along the fiber without breaking into the fiber. The system provided is particularly for hostile environment where the fiber is enclosed in a protective tube or sheath. An example suitable for the invention could be the communication between a down-hole location and a surface location.

SUMMARY OF THE INVENTION

In accordance with a first aspect of the invention, there is provided a telemetry apparatus and method for communicating digital data from a down-hole location through a wellbore to the surface. The apparatus or methods includes a light source; an optical fiber being placed along the length of the wellbore and receiving light from the light source, wherein the optical fiber is surrounded by a protective hull; one or more transducers located to modulate optical properties of the optical fiber interacting with the fiber so as to impart information onto the fiber without breaking into the protective hull at the downhole location; one or more sensors for measuring down-hole conditions and/or parameters; a controller to provide a modulated signal to the transducer, said modulated signal being under operating conditions representative of measurements by the one or more sensors; and an optical detector adapted to detect changes in the properties of light passing through the fiber.

It is another aspect of the invention to provide apparatus and methods for modulating any one or any combination of these properties of the light traveling through the fiber without penetrating the fiber or interrupting its physical integrity of an protective hull, sheath or tube encapsulating the fiber at the point where the modulation is applied. Hence no mechanical element of the transducer extends into or beyond the boundary defined by the hull.

In a variant of the invention the fiber and the modulating transducer are separated without direct mechanical contact. In a preferred embodiment of this variant of the invention the modulating transducer modulates the light properties through a protective sheath or tube that seals the tube from the environment without using or causing a perforation in the protective sheath or tube at the location of modulation. Thus, the fiber can be installed separately from the transducer.

The transducer is preferably a magnetic field generator and even more preferably a solenoid wound around the optical fiber or its protective sheath or tube such that the fiber is preferably guided through the core area of the solenoid.

The invention includes the variant of having several such transducers placed along the length of the fiber thus creating a plurality of communication nodes where data and information can be fed into the fiber.

The light transmitted through the fiber is preferably in a defined known polarization state, and more preferably linear polarized. In operation the transducer may then changes a polarization state of the light passing through the fiber. In a variant of this embodiment, the invention is making use of the Faraday effect.

In another variant of the invention, the transducer changes the amplitude, phase or frequency of the light preferably by causing a mechanical force to act on the fiber. The section of fiber that is affected by the transducer might also be modulated in its optical path length, the change being detectable preferably by interferometric means.

To enhance the effect of the transducer on the fiber, it is preferably at least partially coated with hetero-material designed to respond specifically to the force generated by the transducer. For example a magnetostrictive material may be used in the case of a magnetic field and a, preferably polymeric, piezo-electric coating in case of an electrical field. Heat can also be used as a force field with temperature induced changes of the optical properties of the fiber being registered at the surface.

In yet another variant, information is conveyed to the fiber by means of acoustic waves that modulate the local refractive index of optical fiber via the stress-optical effect and thus modulate the optical path length of the fiber. Such changes in the optical path length can be converted to measurable changes in the light, for example by interferometric techniques.

Still another variant involves applying an electric field across the fiber and modulating its refractive index through the electro-optic effect; the Kerr effect applies to all fibers and responds to the square of the electric field; specially poled fibers are responsive linearly to the electric field through the Pockels effect.

While the apparatus of the invention can be attached directly to casing or production tubing, it is regarded as a preferable placement method to guide the optical fiber through a control line attached to the production tubing with the transducer or transducers being placed such that the optical fiber inside the control line is within the force field.

The optical fiber may either form a loop from a wellhead to the downhole location and returning back to the wellhead to guide light from the source to the detector or may be terminated in the borehole with a mirror.

It is further seen as advantageous to compensate for ambient drifts in the detector signal through the use of a control loop preferably placed at surface. This control loop may include a modulator to change the polarization of light passing through the fiber.

The invention further contemplates the use of a downhole power source to provide a current for the magnetic field generator. If a battery or battery pack is not suitable, the power source can be a generator converting for example pressure fluctuation, temperature gradients or vibrations of tubing into electrical power.

These and other aspects of the invention will be apparent from the following detailed description of non-limitative examples and drawings.

DETAILED DESCRIPTION

In a first example, the light propagating through an optical fiber is assumed to be polarized. The state of polarization at any location inside the fiber refers to the variation of the electric field vector E of the propagating light as a function of time. The most general polarization state is the elliptical polarization, but in the present example the light is assumed to be linear polarized. For a definition of the polarization state the electric field vector can be decomposed into the superposition of two orthogonal fields. When the phase between the two vectors is 0 or $\pi$, the extremity of the electric field vector describes a line. The light is thus polarized linearly.

When light propagates through a given medium, the state of polarization can change and the material is then classified as birefringent. For example, in the case of a circularly birefringent material, the linearly polarized light is strongly affected, whilst the circularly polarized light is unchanged in its state of polarization, although its velocity is dependent on whether the light is left- or right-hand circularly polarized The Faraday effect, which is known as such, is the induction of circular birefringence in some materials by the application of a magnetic field. The circular birefringence induced in the fiber rotates the polarization azimuth by an angle $\theta$. The amount of rotation is expressed in terms of the Verdet coefficient V, which depends on the solid-state properties of the material, its temperature and the wavelength of the propagating light:

$$\theta=\int_0^l V\vec{H}\cdot d\vec{l}, \quad [1]$$

where the integration is carried out over the length of fiber exposed to the external magnetic field, H.

Therefore if the magnetic field is generated by a long solenoid carrying a current I wrapped N times around the fiber (ignoring ending effect), the expression of the angle of rotation can be approximated by:

$$\theta=VNI \quad [2]$$

This is the physical effect used for Faraday magnetometers. To detect the variation of θ, in the polarization azimuth, a polarization analyzer is used.

It was found that the above-described Faraday effect can be advantageously used for the purpose of this invention to transmit signals from a location inside a wellbore to a surface location.

Figure 1:
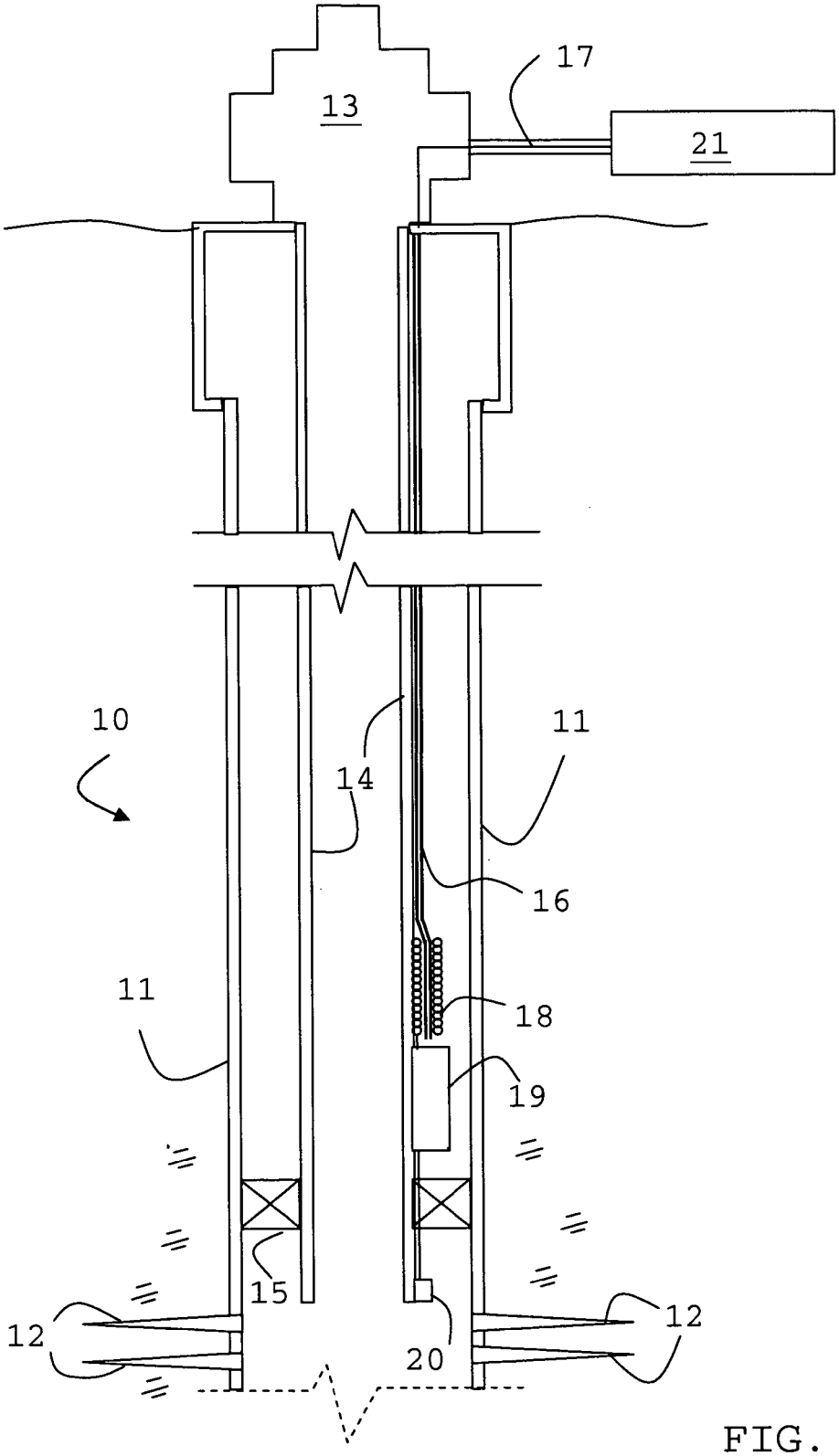
FIG. 1 illustrates elements of an optical fiber telemetry system for a wellbore in accordance with an example of the invention.

In FIG. 1 there is shown the schematics of a wellbore 10. The wellbore 10 is lined with casing tubes 11. The lower part of the wellbore is shown with perforations 12 allowing the entry of produced fluids into the wellbore. The top of the wellbore terminates in a wellhead 13.

Inside the wellbore 10 there is shown part of a production tube 14 to convey produced fluids to the surface. The perforated section of the wellbore 10 is isolated from the remaining sections of the wellbore by a packer 15. Installed alongside the production tubing 14 is a (hydraulic) control line 16.

The control line is used to place an optical fiber 17 into the well using for examples fluid drag methods as disclosed in U.S. Pat. No. Re 37,283, which patent is incorporated herein by reference. The fiber 17 used in the example is a monomode or single-mode fiber known per se.

The example of FIG. 1 further shows a solenoid 18 surrounding the control line 16, a module 19 including a power generator and a controller to control the feeding current for the solenoid 18.

The power generator can be a suitable battery if communication is required only for a limited period of time. Otherwise the present invention contemplates the use of downhole power generators powered for example through the hydraulic line 16. Details of such power generators are for example described in the above referenced international patent application WO 2005/024177 A1, incorporated herein by reference for all purposes.

The module 19 is also connected to sensors 20 which are adapted to measure parameter or downhole conditions such as pressure, temperature, chemical composition, fluid properties, flow conditions and flow components or the state of downhole components, such as control valves, packers and so on. On the surface there is shown further modules 21 designed to project light into the fiber and control and measure the characteristics of the light which passed through the fiber. Details of the surface equipment 21 are shown in FIGS. 2A and 2B.

Figure 2A:
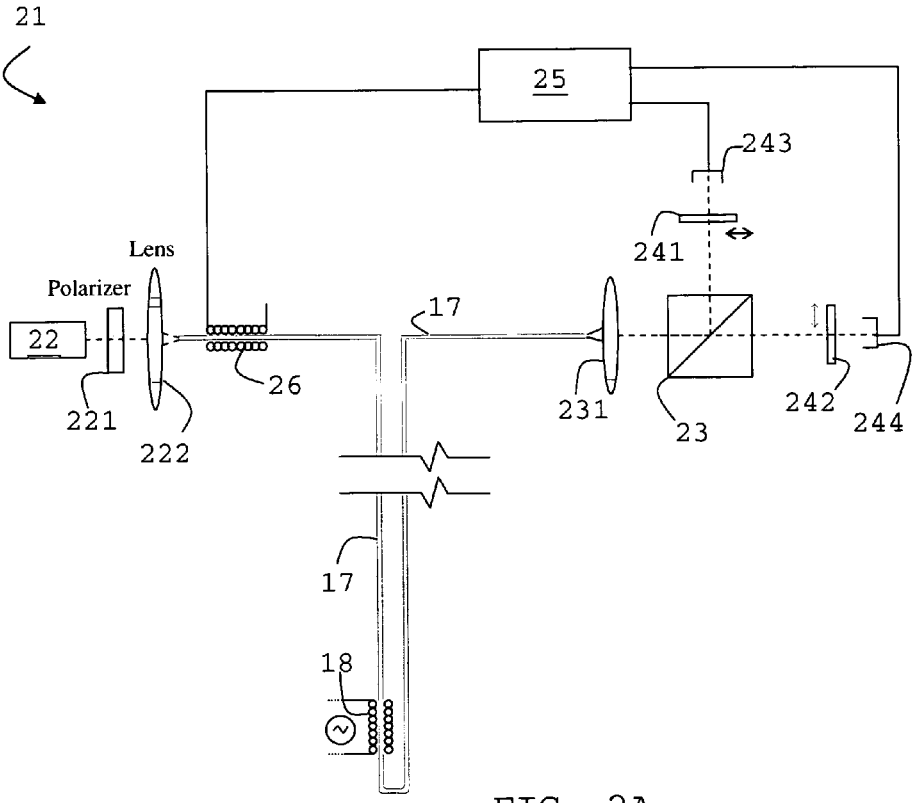
FIG. 2A shows details of an embodiment of the invention using a magnet field.
Figure 2B:
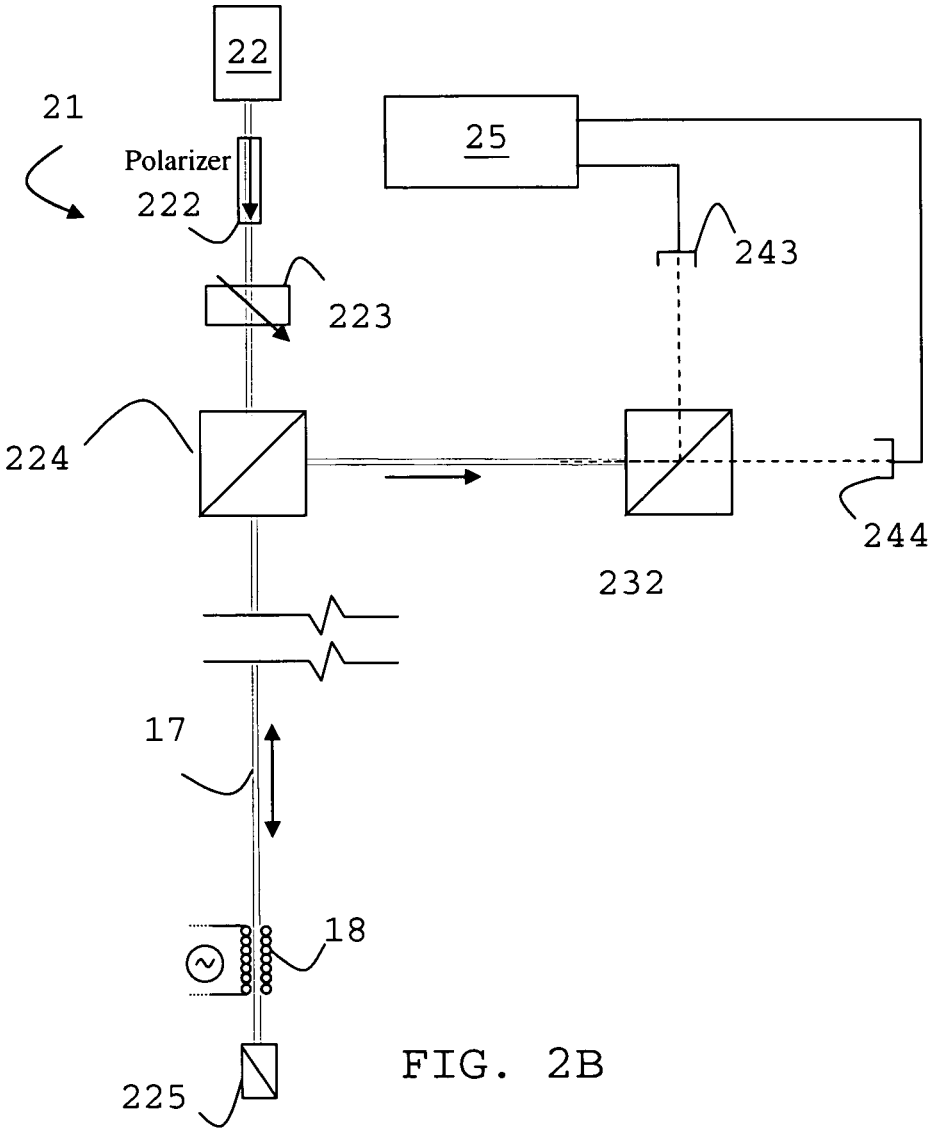
FIG. 2B shows details of a variant of the invention as shown in FIG. 2A.

To the left side of FIG. 2A there is shown a light source, e.g. a laser diode 22. The light emitted by the light source is polarized using a polarizer 221 and projected into the optical fiber 17 using a suitable method, which could be a lens 222 as shown.

Light thus fed into the fiber 17 forms a loop that at a downhole location passed through the core of the solenoid 18 and returns to the surface.

At the surface the light enters a beam-splitter 23 through lens 231. The two beams of light emerging from the beam-splitter are each guided through polarization filters 241, 242 and respective photodetectors 243, 244. The output of the photodetectors 243, 244 is connected to a feedback unit 25 that computes the variation of θ as described above. The feedback unit provides also a controlled amount of current to the compensation solenoid 26 that steers the polarization mode such that the output of the polarization filters 241, 242 is set in accordance with the quadrature condition to be explained in further detail below.

In operation the analogue signal of the down-hole sensor 20 is digitized inside the control module 19. An amplitude, frequency, or phase modulated current corresponding to the obtained data sequence is then applied to the solenoid 18 through which the optical fiber passes axially. This external variation in magnetic field varies the polarization azimuth, θ of the propagating light via the Faraday effect. This change in θ is then detected at the surface via the polarization analyzer 21. The output signal is then demodulated via an amplitude or phase demodulation algorithm as appropriate.

In the polarization analyzer 21, the output light beam goes through the polarizers 241, 242 oriented at ±45° with respect to the input light beam polarization axis, followed by the photo-detectors 243, 244. The signal power at each detector is therefore given by:

$$P=P_o(1\pm\cos 2(\theta+\theta_0)), \quad [3]$$

where $\theta_0$ is the offset angle between the original polarization axis and the polarization azimuth of the output beam without any external magnetic field. The offset value $\theta_0$ is due to the internal birefringence of the fiber and the temperature gradient inside the wellbore. This offset value and the Verdet coefficients are both temperature dependent and will drift. It is therefore difficult to measure absolute variation in θ. Alternatively the functions of 23, 241 and 242 can be combined in a polarizing beamsplitter, such as a Wollaston prism However when following the above set-up the two photodetector outputs are arranged in antiphase:

$$i_1=P_1(1+\cos 2(\theta+\theta_0))$$

$$i_2=P_2(1-\cos 2(\theta+\theta_0)), \quad [4]$$

where $\theta_0$, $P_1$, $P_2$ are constant. The signals $i_1$ and $i_2$ can be recombined differentially and by adjusting the gains a new output is obtained:

$$i_0\approx\cos 2(\theta+\theta_0). \quad [5]$$

This system response is most sensitive at:

$$2(\theta+\theta_0)=\pi/4+2n\pi \quad [6]$$

This is the so-called quadrature condition.

In an ideal system, before the start of data transmission (but with light propagating in the fiber 17), the polarization analyzers are set to satisfy the quadrature condition. However the drift in the offset phase prevents the system from staying at the optimal quadrature condition. Therefore an integration feedback loop using the second coil 26 at the surface is used to restore the quadrature conditions. It will be appreciated that the solenoid can be replaced by any other method known to change the polarization of the light beam such as Lefevre loops, mechanical manipulation (squeezing, twisting) and electro-optical modulation.

To overcome for example linear birefringence induced by bending in the fiber, the fiber may be twisted. Introducing a twist rate onto an optical fiber is known to induce a fixed circular birefringence that annihilates the unwanted linear birefringence effect. Further methods to improve the output may include annealing the fiber.

The above example can be modified to include more fiber-based optical components to eliminate bulk optical components referred to.

In the example of FIG. 2B the laser source used is either a distributed feedback or DFB semiconductor laser or a superluminescent light-emitting or SLD/SLED semiconductor laser diode 22. The DFB laser has very narrow optical bandwidth (<1 MHz) and it is highly polarized optical source with polarization maintaining fiber pigtail. The SLED source has very wide optical bandwidth (>35 nm) and it has single mode fiber pigtail. The output optical power is about 10 mW for both devices.

In order to eliminate any return signal, an optical isolator 222 with a polarization-maintaining fiber pigtail is introduced into the optical circuit. The SPFI-SS device offered by Micro-Optics Inc of Hackettstown, N.J., USA is, an example of a suitable device.

To increase the polarization extinction ratio from the optical source, a fiber pigtailed polarizer 223 may be used. It has a single mode or polarization-maintaining fiber at its input and polarization maintaining fiber at its output. For example, a fiber side-polished type of polarizer may be used and its polarization extinction ratio is about 23 dB. Alternatively, devices based metal inserts in the fiber or coiled birefringent fiber may be used. In certain instances, isolator 222 also incorporates a polarizer function. The plarizer 223 is set to generate linear polarized at 45° from the principal axes of 224. In the case of an all fiber system, this may be accomplished by splicing the output fiber of the polarizer to the input of the coupler 224 such the principal axes of these two fibers are rotated at 45° from each other A special polarization maintaining fiber coupler 224 (a suitable device is one from the PMC-IL-1×2 family provided by Micro-Optics Inc.) is used here. It is based on thin film technology and the polarization extinction ratio is designed to be higher than 23 dB at both its fast and slow axes. The conventional fused-taper polarization maintaining fiber coupler could be used as an alternative with slightly lower performance (specifically, it cannot provide the same splitting ration on both polarization axes).

Behind the coupler 224 the light enters into the fiber 17 and passes through the core of the solenoid 18. The fiber is terminated at the remote end by a Faraday rotate mirror 225. The remote end of the fiber can be sited down the well, or brought up to the surface in a looped control line as described in the previous example.

The Faraday rotate mirror 225 is single mode fiber pigtailed and spliced to the normal single mode fiber 17. At room temperature it will make polarization state change of 90° against its input. The actual state change is however a function of temperature and operating wavelength. The mirror has a relatively narrow optical bandwidth (<20 nm) and also its operating temperature range is quite small (±5° C.). It may be replaced by similar mirrors such as a fiber mirror or a fiber Bragg grating.

The polarization beam combiner 232 is also a fiber component based on thin film technology and it divides the x- and y-polarization components into the separate output arms. A suitable device is, for example, one of the PDM-I1 family supplied by Micro-Optics Inc. The output of both arms is captured using sensitive photo-detectors such as 10 MHz adjustable-bandwidth balanced photo-receivers available as Model 2117 supplied by New Focus Inc.

The 45°-angle splicing between two polarization-maintaining fibers creates two orthogonal linear polarization components along its fast- and slow-axis. Both of them are launching into the PM coupler 224 and propagate along the single mode down-lead fiber 17. The polarization state will change along the single mode fiber, however the returned optical signal will trace back along its original path with rotating 90°-angle after it reflected from the Faraday rotate mirror. Therefore the x- and y-polarization components swap the position after re-entering the PM coupler 224.

Figure 3:
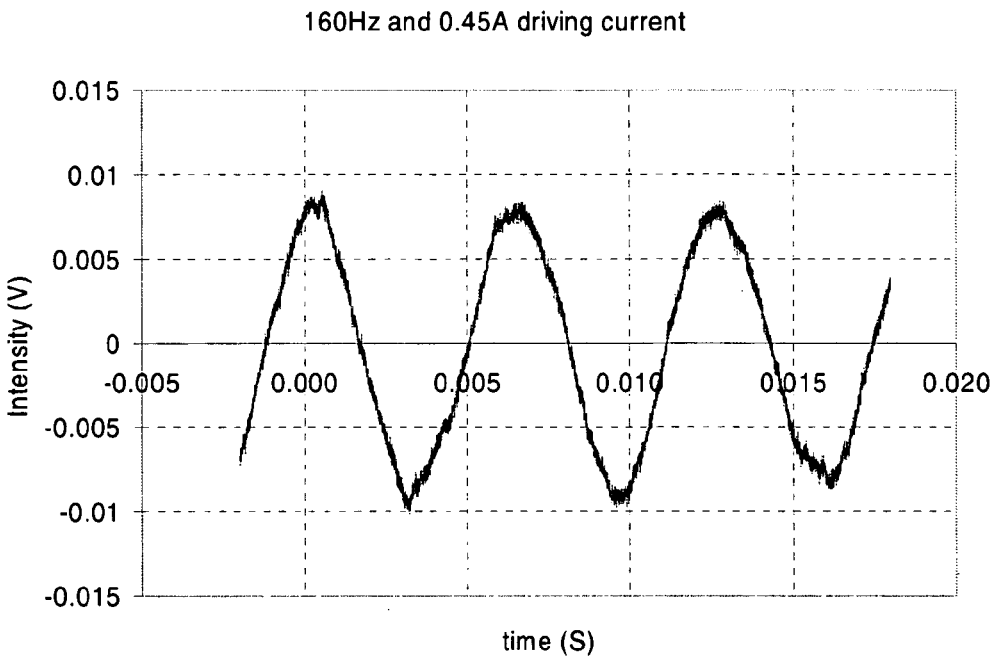
FIG. 3 shows a signal generated using a method in accordance with an example of the invention.

The result of a test of the system of FIG. 2B is shown in the FIG. 3, using a 2 km coiled fiber and a 1800 turn electromagnetic coil and a commercially available polarization controller for adjustment of the polarization state. The wire diameter is 0.56 mm, the length is 200 m and the resistance is measured as 16Ω. The average coil diameter is about 35 mm and sensing fiber length is about 53 mm. Applying a 160 Hz modulation frequency to the coil with a driving current of 0.45 A peak current resulted in the shown single-shot measurement recorded with no further averaging. The gain of the balanced receivers has been set to $3\times10^4$ and the band-pass filter is set from 10 Hz to 1 kHz. In this experiment, the source power at the input to the isolator is 0.75 mW and that reaching each input to the balanced receivers is 7 μW. In further tests, it was found that readily detectable modulation on the optical signal was achieved with an electrical input to the coil below 35 mW.

It was found that the magnetic signals were transmitted through a stainless steel control line without significant effect on the modulation depth.

The variations in a magnetic field or its gradient can also be sensed with an optical fiber by using the induced dimensional change (i.e. strain) in a magneto-strictive element bonded to the fiber. This induced strain forces some light out of the fiber and thus results in a decrease in light intensity. This light intensity can then be modulated according to a recorded digital sequence to transmit data on the optical fiber. At the surface, the light intensity can be monitored by a photo detector.

Figure 4:
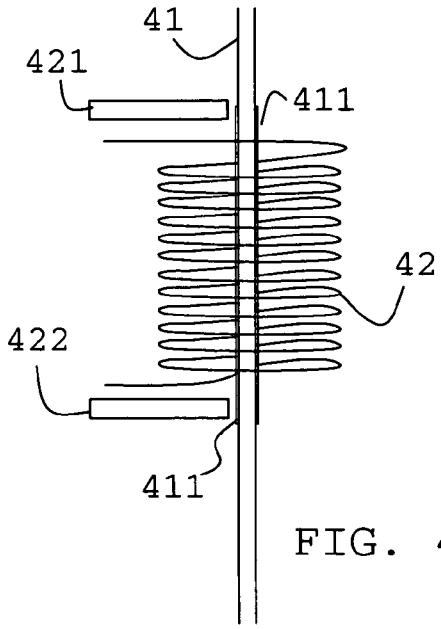
FIG. 4 schematically illustrates another embodiment of the invention.

In this example of the invention, as illustrated in FIG. 4 an optical fiber 41 is locally coated with a layer 411 of magneto-strictive material. In operation this part of the fiber 41 is located downhole in the solenoid 42 similar to the apparatus described above. Permanent magnets 421, 422 are located at each end of the solenoid 42. The magnets are used to indicate an accurate placement of the coated part of the fiber 41 in the solenoid: A first change in the light intensity is registered as the magneto-strictively coated fiber 41 passes the first permanent magnet 421. When the coated part of the fiber exits the solenoid 42 and passes the second permanent magnet 422 a second modulation can be registered at the surface, thus indicating the accurate placement.

In operation the current through the solenoid 42 will be controlled as described above. However, in this embodiment changes in the magnetic field created by the solenoid are translated into a mechanical force on the fiber and thus into a modulation of the light intensity, which is monitored (and demodulated at the surface).

Figure 5A:
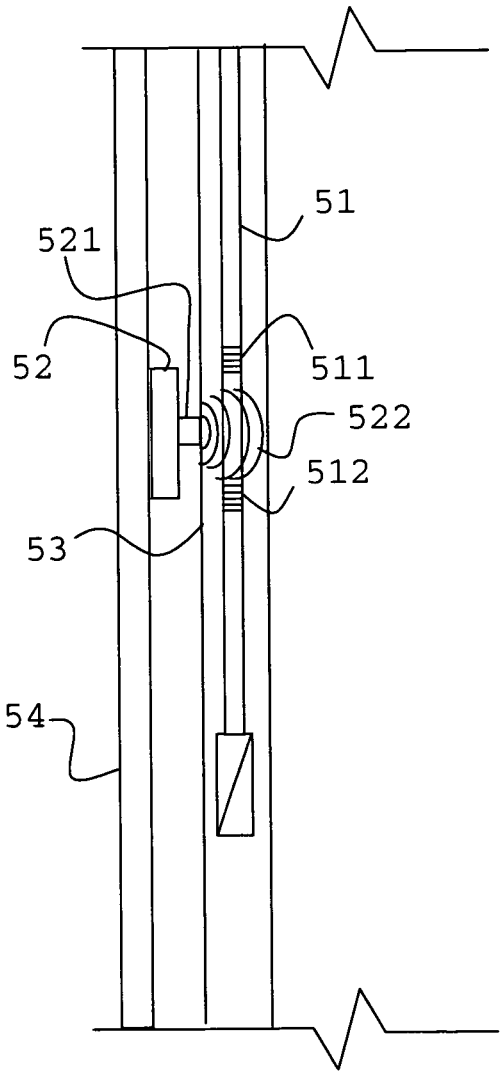
FIG. 5A, B schematically illustrate another embodiment of the invention using a pressure field.
Figure 5B:
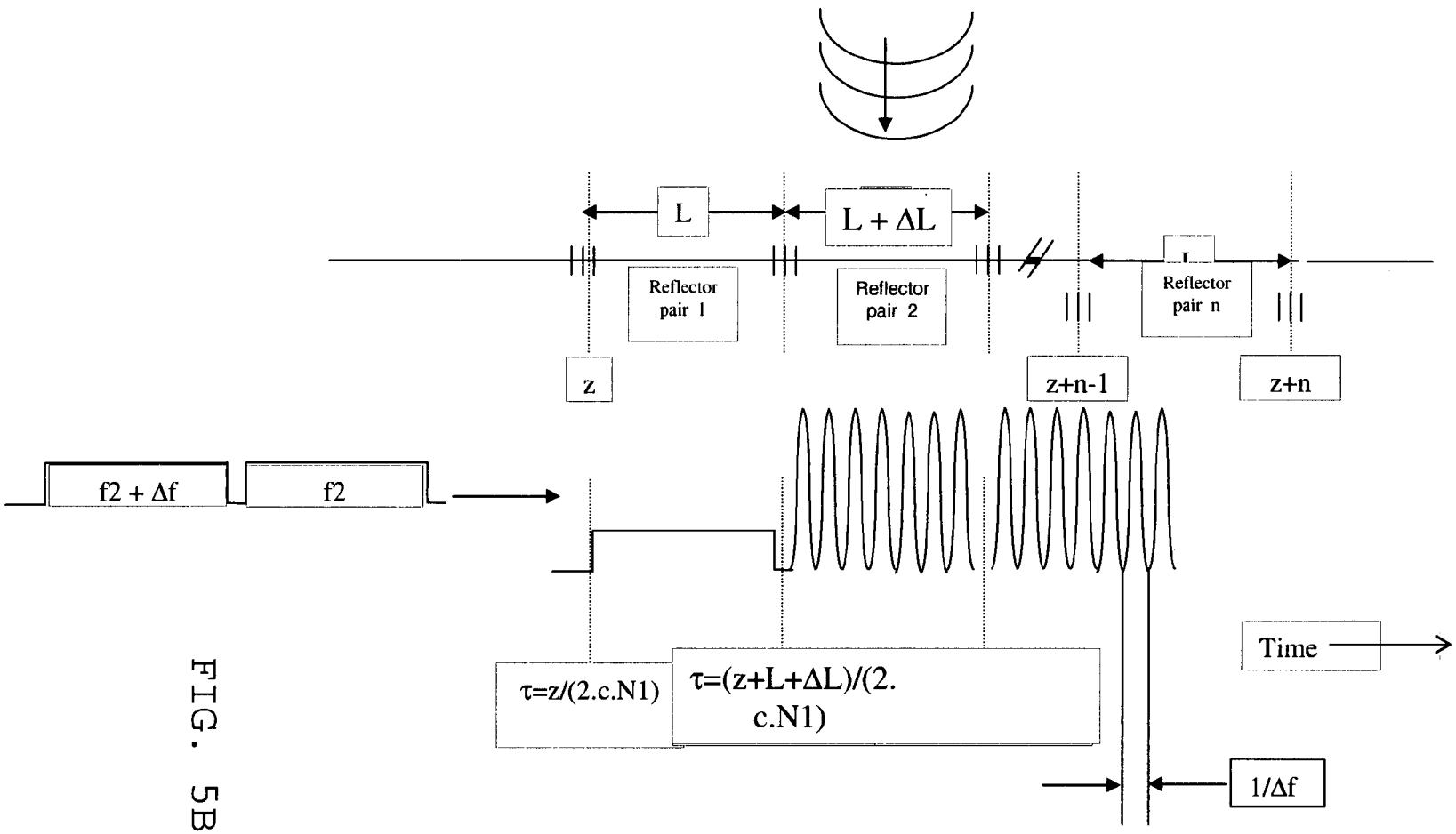

In a further variant of the invention, as shown in FIG. 5A the fiber 51- or a downhole section of the fiber, is formed into an interferometer, for example by providing a least two partial reflectors 511, 512 along its length. Any modulation of the optical length between a reflector pair may be read by a remote interferometer (not shown) which can conveniently be sited at surface. Fibers incorporating reflectors can be formed without significant changes in the external dimensions of the coated fiber, for example, by inscribing gratings 511, 512 into the fiber 51. The spacing between reflectors 511, 512 may be selected to ensure that just one, or several transducer modules 52 are located between the reflectors. The transducer 52 mounted on the outside of a protective tube 53 which is turn is attached to a production tubing 54. The transducer 52 is a piezo-electric transducer using an acoustic horn 521 generating acoustic waves 522 which travel through the protective tube 53 and induces a pressure change inside which is largest in the region between the gratings 511, 512. The acoustic wave generated by the sonic transducer 52 affixed to the control line 53 is focused by the horn 521 inside the control line where the fiber resides. The pressure induces a corresponding change of the optical path length L to L+ΔL between the second pair of gratings as schematically illustrated in FIG. 5B. Optical fiber has a small, but detectable sensitivity to hydrostatic pressure and the sensitivity of the interferometric detection system is sufficient for communications purposes.

The interrogation technique as illustrated in FIG. 5B is described in greater detail but for other purposes by Dakin and Wade in Patent GB2126820 fully incorporated herein by reference.

If more than one pair of reflectors exists, then each can be interrogated individually with minimal cross-talk. The inventors have interrogated arrays incorporating some 40 reflector pairs with better than 1:1000 cross-talk between any element in the array. Given that further multiplexing of such arrays is possible using reflectors optimised for different optical wavelengths, it will be seen that the number of nodes of such a system is essentially unlimited.

Based on the above description, it will be appreciated by a skilled person that any of the above effects which modulate the optical distance between the reflectors in a pair may be used either alone or in combination with other such methods to impart information onto the fiber.

Special coatings can be applied to the fiber to enhance the sensitivity of the fiber to an exposure to acoustic, magnetic or electric waves or fields such as the above-mentioned magneto-strictive coatings or piezo-electric coatings in the case of electric fields. In the case of electric fields, it is also desirable to include in the control line which is generally metallic with a non-conductive section, which in turn can be placed in the electric field generated by a capacitor or dipole. The main direction the electrical field may be parallel or perpendicular to the axis of the optical fiber.

While the invention has been described in conjunction with the exemplary embodiments described above, many equivalent modifications and variations will be apparent to those skilled in the art when given this disclosure. Accordingly, the exemplary embodiments of the invention set forth above are considered to be illustrative and not limiting. Various changes to the described embodiments may be made without departing from the spirit and scope of the invention, for example a temperature gradient may be used as the force field described above. Changes of the temperature modulate the optical properties across the protective hull and can be registered as signal on the surface.

The invention claimed is:

1. A telemetry apparatus for communicating digital data from a downhole location through a wellbore to the surface, said apparatus comprising:

a fluid-filled protective tube extending along the length of the wellbore from the surface to the downhole location;

a light source at the surface;

an optical fiber being placed along the length of the wellbore within the protective tube and receiving light from the light source, an optical detector at the surface adapted to receive the light from the optical fiber and detect changes in the properties of the light passing through the optical fiber, wherein the optical fiber defines a continuous optical path within the wellbore for transmission of the light from the light source to the downhole location and then back to the detector, and wherein the optical fiber is surrounded by the protective tube;

one or more transducer downhole which includes a source of a magnetic field, an electric field or a combination thereof and which is located at the exterior of the protective tube to modulate optical properties of the optical fiber by action of the magnetic field, electric field or the combination thereof on the optical fiber with at least a layer of fluid material within the protective tube separating the optical fiber within the protective tube from the one or more transducer at the exterior of the protective tube so as to impart information onto the optical fiber without direct mechanical contact between the one or more transducer and the optical fiber nor breaking into the protective tube at the downhole location;

one or more sensors for measuring downhole conditions and/or parameters; and a controller to provide a modulated signal to the one or more transducer, said modulated signal being under operating conditions representative of measurements by the one or more sensors;

wherein the apparatus is configured such that the information is from the one or more sensors and is imparted through the protective tube to the optical fiber at the downhole location without direct mechanical contact between the one or more transducer and the optical fiber nor breaking into the protective tube at the downhole location.

2. The telemetry apparatus of claim 1 wherein the one or more transducer is a solenoid wound around the protective tube.

3. The telemetry apparatus of claim 1, wherein the one or more transducer is located along the length of the optical fiber away from any terminals of the optical fiber.

4. The telemetry apparatus of claim 1 wherein the light entering the optical fiber is polarized.

5. The telemetry apparatus of claim 1 wherein the one or more transducer in operation changes a polarization state of the light passing through the optical fiber.

6. The telemetry apparatus of claim 1 making use of a Kerr effect or a Faraday effect.

7. The telemetry apparatus of claim 1 wherein the one or more transducer changes the amplitude of the light.

8. The telemetry apparatus of claim 1 wherein the one or more transducer causes a change in the optical path length through the optical fiber.

9. The telemetry apparatus of claim 1 wherein the magnetic field, electric field or the combination thereof causes a mechanical force to act on the optical fiber.

10. The telemetry apparatus of claim 1 wherein at least a downhole portion of the optical fiber within the protective tube, at the location of the one or more transducer outside the protective tube, is coated with a material specifically sensitive to the magnetic field, electric field or the combination thereof so as to enhance the effect of the magnetic field, electric field or the combination thereof generated from outside the protective tube on the optical fiber within the protective tube.

11. The telemetry apparatus of claim 10 wherein the one or more transducer is configured to provide the magnetic field, and the coating of the at least downhole portion of the optical fiber is a magnetostrictive coating.

12. The telemetry apparatus of claim 10 wherein the one or more transducer is configured to provide the electric field, and the coating of the at least downhole portion of the optical fiber is a piezoelectric coating.

13. The telemetry apparatus of claim 1 wherein the optical fiber forms a loop from a wellhead to the downhole location and returning back to the wellhead to guide the light from the light source to the detector.

14. The telemetry apparatus of claim 1 wherein the optical fiber is terminated in the wellbore with a mirror.

15. The telemetry apparatus of claim 1 wherein the optical fiber is terminated in the wellbore with a Faraday rotate mirror.

16. The telemetry apparatus of claim 1 further comprising a control loop to compensate for ambient drifts in the light passing through the optical fiber.

17. The telemetry apparatus of claim 16 wherein the control loop includes a modulator to change the polarization of the light passing through the optical fiber.

18. The telemetry apparatus of claim 16 wherein the control loop includes a beam splitter to divide the light passing through the optical fiber.

19. The telemetry apparatus of claim 1 further comprising a power source in the wellbore.

20. The telemetry apparatus of claim 19 wherein the power source is a battery or a generator.

21. The telemetry apparatus of claim 19 wherein the power source is a generator converting pressure fluctuation, temperature gradients or vibrations of tubing into electrical power.

22. The telemetry apparatus of claim 1 wherein the protective tube is a hydraulic control line and the one or more transducer is located outside the control line with no part, element or connector penetrating the control line.

23. The wellbore of claim 1 wherein the optical fiber is a single mode optical fiber.

24. A method of communicating digital data from a downhole location through a wellbore to the surface comprising the steps of:

installing a fluid-filled protective tube along the length of the wellbore and installing at least one downhole transducer which includes a source of a magnetic field, an electric field or a combination thereof at the exterior of the protective tube at the downhole location with the at least one downhole transducer positioned to create a magnetic force or electric force field within the protective tube;

installing an optical fiber within the protective tube such that the optical fiber defines a continuous optical path within the wellbore for transmission of light from the surface to the downhole location and then back to a detector at the surface;

letting the light enter into the optical fiber at the surface;

using the at least one downhole transducer located outside the protective tube to create the magnetic force or electric force field to modulate properties of the optical fiber at the downhole location with at least a layer of fluid material separating the optical fiber from the at least one downhole transducer so as to be without mechanical contact between the at least one downhole transducer and the optical fiber and without breaking into the protective tube at the downhole location;

using one or more sensors to measure downhole conditions and/or parameters;

providing a modulated signal to the at least one downhole transducer to control the magnetic force or electric force field, said modulated signal being under operating conditions representative of measurements by the one or more sensors whereby information from the one or more sensors is imparted through the protective tube to the optical fiber at the downhole location without mechanical contact between the at least one downhole transducer and the optical fiber and without breaking into the protective tube at the downhole location; and detecting changes in the light intensity or polarization of the light passing through the optical fiber.

25. The method of claim 24 wherein the at least one downhole transducer generates the magnetic force field using a solenoid.

26. The method of claim 25 wherein the magnetic force field is generated using the solenoid, the solenoid being wound around the protective tube.

27. The method of claim 24, further comprising generating several magnetic force or electric force fields along the length of the optical fiber in the wellbore.

28. The method of claim 24 wherein the light entering the optical fiber is polarized.

29. The method of claim 24 wherein the magnetic force or electric force field in operation changes a polarization state of the light passing through the optical fiber.

30. The method of claim 24, further comprising using a Kerr effect or a Faraday effect.

31. The method of claim 24, further comprising the step of modulating the optical path length through the optical fiber.

32. The method of claim 24 wherein the magnetic force or electric force field changes the amplitude of the light.

33. The method of claim 24 wherein the magnetic force or electric force field causes a mechanical force to act on the optical fiber.

34. The method of claim 24 wherein the protective tube is a hydraulic control line attached to tubing.

35. The method of claim 24 wherein the optical fiber forms a loop from a wellhead to the downhole location and returning back to the wellhead to guide the light from a light source to the detector.

36. The method of claim 24 wherein the optical fiber is terminated in the wellbore with a mirror.

37. The method of claim 24 further comprising compensating for ambient drifts in a detector signal.

38. The method of claim 37 wherein the compensating includes adjusting the polarization of the light passing through the optical fiber.

39. The method of claim 37 further comprising dividing the light passing through the optical fiber into at least two beams.

40. The method of claim 24 wherein at least a downhole portion of the optical fiber, at the location of the at least one downhole transducer, is coated with a material specifically sensitive to the magnetic force or electric force field, so as to enhance the effect of the magnetic force or electric force field on the optical fiber.

41. The method of claim 24 wherein the protective tube is a hydraulic control line.

42. A telemetry apparatus for communicating digital data from a downhole location through a wellbore to the surface, said apparatus comprising:

a protective hull extending along the length of the wellbore;

a light source at the surface;

an optical fiber being placed along the length of the wellbore within the protective hull and terminated in the wellbore with a mirror, the optical fiber receiving light reflected from the light source;

an optical detector at the surface adapted to receive the light from the optical fiber and detect changes in the properties of the light passing through the optical fiber, wherein the optical fiber defines a continuous optical path within the wellbore for transmission of the light from the light source to the downhole location and then back to the detector;

at least one transducer downhole comprising a solenoid around the exterior of the protective hull to modulate optical properties of the optical fiber by generating a magnetic field, an electric field or a combination thereof that interacts with the optical fiber with at least a fluid material separating the optical fiber from the at least one transducer so as to impart information onto the optical fiber without direct mechanical contact between the solenoid and the optical fiber nor breaking into the protective hull at the downhole location;

one or more sensors for measuring downhole conditions and/or parameters; and a controller to provide a modulated signal to the at least one transducer, said modulated signal being under operating conditions representative of measurements by the one or more sensors;

wherein the apparatus is configured such that the information is from the one or more sensors and is imparted through the protective hull to the optical fiber at the downhole location without direct mechanical contact between the solenoid and the optical fiber nor breaking into the protective hull at the downhole location.

43. A method of communicating digital data from a downhole location through a wellbore to the surface comprising the steps of:

installing within the wellbore an optical fiber enclosed within a protective hull and terminated with a mirror such that the optical fiber defines a continuous optical path within the wellbore for transmission of light from the surface to the mirror and then back to a detector at the surface;

letting the light enter into the optical fiber at the surface;

using a downhole transducer which is a solenoid around the exterior of the protective hull to create a magnetic force field, an electric force field or a combination thereof to modulate properties of the optical fiber at the downhole location with at least a layer of fluid material separating the optical fiber from the downhole transducer so as to be without mechanical contact between the solenoid and the optical fiber and without breaking into the protective hull at the downhole location;

using one or more sensors to measure downhole conditions and/or parameters;

providing a modulated signal to the downhole transducer to control the magnetic force field, electric force field or the combination thereof, said modulated signal being under operating conditions representative of measurements by the one or more sensors whereby information from the one or more sensors is imparted through the protective hull to the optical fiber at the downhole location without mechanical contact between the solenoid and the optical fiber and without breaking into the protective hull at the downhole location; and detecting changes in the light intensity or polarization of the light reflected back to the surface through the optical fiber.

* * * * *